United States Patent [19]

Yamamura et al.

[11] Patent Number: 4,622,270

[45] Date of Patent: Nov. 11, 1986

[54] INORGANIC FIBER-REINFORCED METALLIC COMPOSITE MATERIAL

[75] Inventors: Takemi Yamamura; Masahiro Tokuse; Teruhisa Furushima, all of Ube, Japan

[73] Assignee: Ube Industries, Ltd., Yamaguchi, Japan

[21] Appl. No.: 794,298

[22] Filed: Nov. 1, 1985

[30] Foreign Application Priority Data

Nov. 6, 1984 [JP] Japan ..... 59-232457

[51] Int. Cl.[4] ..... B32B 15/14

[52] U.S. Cl. ..... 428/608; 428/614

[58] Field of Search ..... 428/614, 608, 567, 568, 428/627, 632, 641, 639, 935, 936, 937, 938; 164/97; 419/24

[56] References Cited

U.S. PATENT DOCUMENTS

| | | | |
|---|---|---|---|
| 3,455,662 | 7/1969 | Alexander et al. | 428/614 |
| 3,717,443 | 2/1973 | McMurray et al. | 428/614 |
| 3,889,348 | 6/1975 | Lemelson | 428/608 |
| 3,900,626 | 8/1975 | Brennan | 428/614 |
| 4,359,559 | 11/1982 | Yajima et al. | 528/25 |
| 4,547,435 | 10/1985 | Yamatsuta et al. | 428/614 |

OTHER PUBLICATIONS

Metal Matrix Composites, Kenneth G. Krader, vol. 4, Academic Press, N.Y., 1974, pp. 24–29, 39–41, 258, 208–377.

*Primary Examiner*—L. Dewayne Rutledge
*Assistant Examiner*—John J. Zimmerman
*Attorney, Agent, or Firm*—Ladas & Parry

[57] ABSTRACT

An inorganic fiber-reinforced metallic composite material comprising a matrix of a metal or its alloy and inorganic fibers as a reinforcing material, characterized in that (a) the inorganic fibers are inorganic fibers containing silicon, either titanium or zirconium, nitrogen and oxygen and being composed of
  (i) an amorphous material consisting substantially of Si, M, N and O, or
  (ii) an aggregate consisting substantially of ultrafine crystalline particles with a particle diameter of not more than 500 Å of $Si_2N_2O$, MN, $Si_3N_4$ and/or $MN_{1-x}$, and amorphous $SiO_2$ and $MO_2$, provided that in the above formulae, M represents titanium or zirconium, and x is a number represented by $0<x<1$, or
  (iii) a mixture of the amorphous material (i) and the aggregate (ii), and (b) said metal is selected from the group consisting of aluminum, magnesium, and titanium, or (c) said alloy is selected from the group consisting of aluminum alloys, magnesium alloys and titanium alloys.

8 Claims, 1 Drawing Figure

INORGANIC FIBER-REINFORCED METALLIC COMPOSITE MATERIAL

BACKGROUND OF THE INVENTION

This invention relates to an inorganic fiber-reinforced metallic composite material (to be abbreviated as a composite material) having excellent mechanical properties and comprising a matrix of a metal or its alloy (to be inclusively referred to as a metal) and inorganic fibers composed mainly of silicon, either titanium or zirconium, nitrogen and oxygen as a reinforcing material.

Some patent documents including Japanese Laid-Open Patent Publications Nos. 7811/1977, 24111/1977, 30407/1978 and 26305/1977 disclose that non-surface-treated silicon carbide fibers obtained by spinning organic silicon polymers called polycarbosilanes, rendering the fibers infusible and calcining the infusible fibers show excellent mechanical strength when used as reinforcing fibers for metals such as aluminum, magnesium and titanium. However, when these silicon carbide fibers are immersed in a molten bath of a metal such as aluminum, their strength is reduced markedly as shown in Referential Example given hereinafter, and the strength of a composite material composed of a matrix of aluminum and the reinforcing silicon carbide fibers is much lower than its theoretical strength calculated from the strength and volumetric proportion of the fibers.

SUMMARY OF THE INVENTION

The present inventors have extensively worked on the application of inorganic fibers comprising mainly silicon, titanium or zirconium, nitrogen and oxygen produced from the organometal polymers disclosed previously by the present inventors in Japanese Laid-Open Patent Publication No. 92923/1981 to composite materials. The work has led to the discovery that a composite metal material comprising the inorganic fibers as a reinforcing material exhibits much better mechanical strength than a composite metal material comprising silicon carbide fibers as a reinforcing material.

It is an object of this invention to provide a composite material of excellent mechanical properties which offers a solution to the aforesaid problem of the prior art.

Another object of this invention is to provide a composite material comprising a matrix of a metal and inorganic fibers, which are bonded to each other with excellent strength.

Still another object of this invention is to provide a composite material comprising a matrix of a metal and inorganic fibers which shows excellent compatibility between the components and an excellent reinforcing efficiency by the inorganic fibers.

Yet another object of this invention is to provide a composite material comprising a matrix of a metal and inorganic fibers which can be produced without a reduction in the tenacity of the inorganic fibers.

An additional object of this invention is to provide a composite material which lends itself to mass production.

According to this invention, there is provided an inorganic fiber-reinforced metallic composite material comprising a matrix of a metal or its alloy and inorganic fibers as a reinforcing material, characterized in that (a) the inorganic fibers are inorganic fibers containing silicon, either titanium or zirconium, nitrogen and oxygen and being composed of (i) an amorphous material consisting substantially of Si, M, N and O, or (ii) an aggregate consisting substantially of ultrafine crystalline particles with a particle diameter of not more than 500 Å of $Si_2N_2O$, MN, $Si_3N_4$ and/or $MN_{1-x}$, and amorphous $SiO_2$ and $MO_2$, provided that in the above formulae, M represents titanium or zirconium, and x is a number represented by $0<x<1$, or (iii) a mixture of the amorphous material (i) and the aggregate (ii), and (b) said metal is selected from the group consisting of aluminum, magnesium and titanium, or (c) said alloy is selected from the group consisting of aluminum alloys, magnesium alloys and titanium alloys.

DETAILED DESCRIPTION OF THE INVENTION

Figure 1:
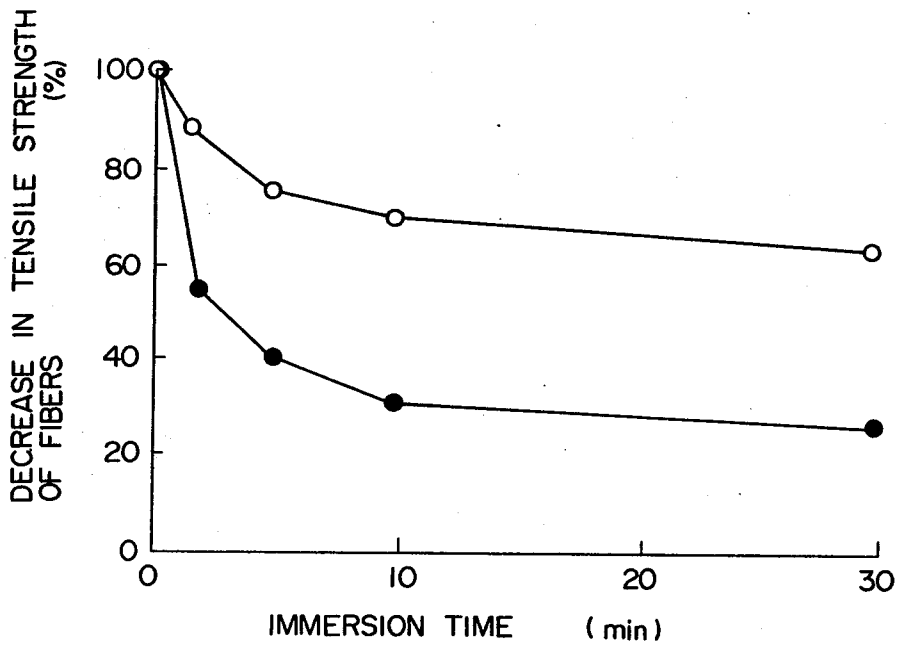
FIG. 1 is a graphic representation showing a percent decrease of tensile strength when the inorganic fibers (I) in accordance with this invention ( ○ ) and silicon carbide fibers ( • ) were immersed in molten aluminum (1070).

Inorganic fibers consisting substantially of Si, Ti, N and O or of Si, Zr, N and O can be produced by a method which comprises:

a first step of mixing (1) a polycarbosilane having a number average molecular weight of about 500 to 10,000 and a main-chain skeleton composed mainly of structural units of the formula $\text{-}(\text{Si}—\text{CH}_2)\text{-}$ in which the silicon atom substantially has two side-chain groups selected from the class consisting of hydrogen atoms, lower alkyl groups and phenyl groups with (2) a polymetallosiloxane having a number average molecular weight of about 500 to 10,000 and a main-chain skeleton composed of metalloxane units of the formula $\text{-}(\text{M}—\text{O})\text{-}$ wherein M represents Ti or Zr and siloxane units of the formula $\text{-}(\text{Si}—\text{O})\text{-}$, the ratio of the total number of the metalloxane units to that of the siloxane units being in the range of from 30:1 to 1:30, most of the silicon atoms of the siloxane units having 1 or 2 side-chain groups selected from the class consisting of lower alkyl and phenyl groups and most of the metal atoms of the metalloxane units having 1 or 2 lower alkoxy groups as side-chain groups, in such a mixing ratio that the ratio of the total number of the $\text{-}(\text{Si}—\text{CH}_2)\text{-}$ structural units of the polycarbosilane to the total number of the $\text{-}(\text{M}—\text{O})\text{-}$ units and the $\text{-}(\text{M}—\text{O})\text{-}$ units and the $\text{-}(\text{Si}—\text{O})\text{-}$ units is in the range of from 100:1 to 1:100, and heating the resulting mixture in an organic solvent in an atmosphere inert to the reaction to bond at least some of the silicon atoms of the polycarbosilane to at least some of the silicon atoms and/or metal atoms of the polymetallosiloxane through oxygen atoms and thereby form an organic metal polymer having a number average molecular weight of about 1000 to 50,000 and composed of a crosslinked polycarbosilane moiety and polymetallosiloxane moiety;

a second step of preparing a spinning dope of the resulting polymer and spinning it;

a third step of rendering the spun fibers infusible under tension or under no tension; and a fourth step of calcining the infusible fibers in vacuum or in an atmosphere of an ammonia gas at a temperature in the range of 800° to 1650° C.

Alternatively, the inorganic fibers consisting substantially of Si, Ti, C and O or of Si, Zr, N and O can be produced by a process which comprises:

a first step of mixing a polycarbosilane having a number average molecular weight of 200 to 10,000 and mainly containing a main-chain skeleton represented by the general formula

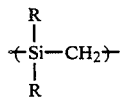

wherein R represents a hydrogen atom, a lower alkyl group or a phenyl group, and an organic metal compound represented by the general formula $MX_4$ wherein M represents Ti or Zr and X represents an alkoxy group containing 1 to 20 carbon atoms, a phenoxy group, or an acetylacetoxy group, in such mixing ratios that the ratio of the total number of the structural units of the formula —Si—$CH_2$— to the total number of the structural units of the formula -(M—O)- of the organic metal compound is in the range of from 2:1 to 200:1, and reacting the mixture under heat in an atmosphere inert to the reaction to bond at least some of the silicon atoms of the polycarbosilane to the metal atoms of the organic metal compound through oxygen atoms and form an organic metallic polymer having a number average molecular weight of about 700 to 100,000;

a second step of preparing a spinning dope of the organic metal polymer and spinning it;

a third step of rendering the spun fibers insoluble under tension or under no tension; and a fourth step of calcining the infusible fibers at a temperature of 800° to 1650° C. in an atmosphere of an ammonia gas.

The inorganic fibers contain 30 to 60% by weight of Si, 0.5 to 35% by weight, preferably 1 to 10% by weight, of Ti or Zr, 10 to 40% by weight of N, and 0.01 to 30% by weight of O.

The inorganic fibers may be used in various forms, for example in the form of a blend of these fibers arranged monoaxially or multiaxially, a woven fabric such as a fabric of the plain, satin, imitation gauze, twill or leno weave or a helically or three-dimensionally woven fabric, or chopped strands.

Examples of the metal which can be used in the composite material of this invention are aluminum, aluminum alloys, magnesium, magnesium alloys, titanium and titanium alloys.

The proportion of the inorganic fibers to be mixed with the matrix is preferably 10 to 70% by volume, more preferably 20 to 60% by volume.

The metallic composite material of this invention may be produced by ordinary methods for producing fiber-reinforced metallic composites, for example by (1) a diffusion bonding method, (2) a melting-penetration method, (3) a flame spraying method, (4) an electrodeposition method, (5) an extrusion and hot roll method, (6) a chemical vapor deposition method, and (7) a sintering method. These methods will be more specifically described below.

(1) According to the diffusion bonding method, the composite material can be produced by arranging the inorganic fibers and metal wires as the matrix alternately in one direction, covering both surfaces of the resulting assembly with thin films of the matrix metal or covering its under surface with a thin film of the matrix metal and its upper surface with a powder of the matrix metal mixed with an organic binder to form a composite layer, stacking several such layers, and thereafter consolidating the stacked layers under heat and pressure. The organic binder is desirably one which volatilizes before it is heated to a temperature at which it forms a carbide with the matrix metal. For example, CMC, paraffin, resins, and mineral oils are preferably used. Alternatively, the composite material may be produced by applying a powder of the matrix metal mixed with the organic binder to the surface of a mass of the inorganic fibers, stacking a plurality of such assemblies, and consolidating the stacked assemblies under heat and pressure.

(2) According to the melting-penetration method, the composite material may be produced by filling the interstices of arranged inorganic fibers with a molten mass of aluminum, an aluminum alloy, magnesium, a magnesium alloy, titanium or a titanium alloy. Since wetting between the fibers and the matrix metal is good, the interstices of the arranged fibers can be uniformly filled with the matrix metal.

(3) According to the flame spray method, the composite material can be produced in tape form by coating the matrix metal on the surface of arranged inorganic fibers by plasma spraying or gas spraying. It may be used as such, or if desired, a plurality of such tape-like composite materials are stacked and processed by the diffusion bonding method described in (1) above to produce a composite material.

(4) According to the electrodeposition method, the matrix metal is electrolytically deposited on the surface of the fibers to form a composite. A plurality of such composites are stacked and processed by the diffusion bonding method (1) to produce a composite material.

(5) According to the extrusion and hot roll method, the composite material can be produced by arranging the inorgnaic fibers in one direction, sandwiching the arranged fibers with foils of the matrix metal, and passing the sandwiched structure through optionally heated rolls to bond the fibers to the matrix metal.

(6) According to the chemical vapor deposition method, the composite material may be produced by introducing the inorgnaic fibers into a heating furnace, thermally decomposing them by introducing a gaseous mixture of, for example, aluminum chloride and hydrogen gas to deposit the aluminum metal on the surface of the fibers, stacking a plurality of such metal-deposited inorganic fiber masses, and processing them by the diffusion bonding method (1). (7) According to the sintering method, the composite material can be produced by filling the interstices of arranged inorganic fibers with a powder of the matrix metal, and then sintering them under heat with or without pressure.

The tensile strength ($\sigma_c$) of the composite material produced from the inorganic fibers and the metal matrix is represented by the following formula.

$$\sigma_c = \sigma_f V_f + \sigma_M V_M$$

wherein $\sigma_c$: the tensile strength of the composite material, $\sigma_f$: the tensile strength of the inorganic fibers, $\sigma_M$: the tensile strength of the matrix metal $V_f$: the percent by volume of the inorganic fibers, $V_M$: the percent by volume of the matrix metal.

As shown by the above formula, the strength of the composite material becomes larger as the volumetric proportion of the inorganic fibers in the composite material becomes larger. To produce a composite material having high strength, the volumetric proportion of the inorganic fibers should be increased. If, however, the volumetric proportion of the inorganic fibers exceeds 70%, the amount of the metal matrix becomes smaller and it is impossible to file the interstices of the inorganic fibers fully with the matrix metal. The resulting composite material fails to exhibit the strength represented by the above formula. If, on the other hand, the amount of the fibers is decreased, the strength of the composite material respresented by the above formula is reduced. To obtain composite materials of practical use, it is necessary to incorporate at least 10% of the inorganic fibers. Accordingly, the best results can be obtained in the production of the inorganic fiber-reinforced metallic compoiste of this invention when the volumetric proportion of the inorganic fibers to be incorporated is adjusted to 10 to 70%.

In the production of the composite material, it is necessary to heat the metal to a temperature to near or above the melting temperature and consolidate it with the inorganic fibers. At such temperatures, the metal reacts with the inorganic fibers to reduce the strength of the fibers, and the desired tensile strength ($\sigma_c$) of the composite cannot be fully obtained.

In contrast, when the inorganic fibers used in this invention are immersed in a molten bath of the matrix metal, no such abrupt degradation of the inorganic fibers as in ordinary silicon carbide fibers is observed.

The tensile strength property, as used herein, is measured by the following methods.

(1) When a metal or its alloy having a melting point of not more than 1200° C. is used:

The inorganic fibers are immersed for 1, 5, 10, and 30 minutes respectively in a molten metal heated to a temperature 50° C. higher than its melting point. The fibers are then withdrawn and their tensile strength is measured.

(2) When a metal or its alloy having a melting point higher than 1200° C. is used:

The inorganic fibers and a foil of the metal are stacked, and the assembly is heated in vacuum to a temperature corresponding to the melting point of the metal foil multiplied by (0.6–0.7), and maintained under a pressure of 5 kg/mm$^2$ for a period of 5, 10 and 30 minutes, respectively. The fibers are then separated, and their tensile strength is measured.

Since the inorganic fiber-reinforced material of this invention has excellent mechanical properties such as tensile strength, high moduli of elasticity, and excellent heat resistance and abrasion resistance, it is useful as synthetic fibrous materials, materials for synthetic chemistry, materials for mechanical industry, materials for construction machinery, materials for marine and space exploitation, automotive materials, food packing and storing materials, etc.

Production of inorganic fibers (I)

Three parts by weight of polyborosiloxane is added to 100 parts by weight of polydimethylsilane synthesized by dechlorinating condensation of dimethyldichlorosilane with metallic sodium. The mixture was subjected to thermal condensation at 350° C. in nitrogen to obtain polycarbosilane having a main-chain skeleton composed mainly of carbosilane units of the formula $\text{-}(\text{Si—CH}_2)\text{-}$ and containing a hydrogen atom and a methyl group attached to the silicon atom of the carbosilane units. A titanium alkoxide is added to the resulting polycarbosilane, and the mixture is subjected to crosslinking polymerization at 340° C. in nitrogen to obtain polytitanocarbosilane composed of 100 parts of the carbosilane units and 10 parts of titanoxane units of the formula $\text{-}(\text{Ti—O})\text{-}$. The polymer is melt-spun, and treated in air at 190° C. to render the fibers infusible. Subsequently, the fibers are calcined in an ammonia gas stream at 1300° C. to obtain inorganic fibers (I) consisting mainly of silicon, titanium (3% by weight), nitrogen and oxygen and having a diameter of 13 microns, a tensile strength of 300 kg/mm$^2$ and a modulus of elasticity of 17 tons/mm$^2$. The resulting inorganic fibers are composed of a mixture of an amorphous material consisting of Si, Ti, N and O and an aggregate of ultrafine crystalline particles with a particle diameter of about 50 Å of $Si_2N_2O$, $Si_3N_4$, TiN and/or $TiN_{1-x}$ ($0<x<1$) and amorphous $SiO_2$ and $TiO_2$. The inorganic fibers contain 47.9% by weight of Si, 3.0% by weight of Ti, 25.6% by weight of N and 22.1% by weight of O.

Production of inorganic fibers (II)

Tetrakis-acetylacetonato zirconium is added to the polycarbosilane obtained as described above, and the mixture is subjected to crosslinking polymerization at 350° C. in nitrogen to obtain polyzirconocarbosilane composed of 100 parts of carbosilane units and 30 parts of zirconoxane units of the formula $\text{-}(\text{Zr—O})\text{-}$. The polymer is dissolved in benzene and dry-spun, and treated in air at 170° C. to render the fibers infusible. Subsequently, the fibers are calcined at 1200° C. in an ammonia gas stream to obtain inorganic fibers (II) consisting mainly of silicon, zirconium, nitrogen and oxygen with 6.0% by weight of amorphous zirconium element and having a diameter of 10 microns, a tensile strength of 340 kg/mm$^2$, and a modulus of elasticity of 18 tons/mm$^2$. The inorganic fibers contain 46.8% by weight of Si, 6.0% by weight of Zr, 29.4% by weight of N and 16.2% by weight of O.

REFERENTIAL EXAMPLE

The inorganic fibers (I) used in this invention and silicon carbide fibers obtained from polycarbosilane alone and having a diameter of 13 microns, a tensile strength of 300 kg/mm$^2$ and a modulus of elasticity of 16 tons/mm$^2$ were each immersed for 30 minutes in a molten bath of pure aluminum (1070) at 670° C., and the reductions in tensile strength of the two fibers were compared.

The data obtained ar plotted in FIG. 1. It is seen from FIG. 1 that in molten aluminum the percent decrease of the tensile strength of the inorganic fibers in accordance with this invention is very much smaller than that of the silicon carbide fibers, and therefore that the tensile strength of a composite metal material comprising aluminum as a matrix is much higher by including the inorganic fibers of this invention than by including the silicon carbide fibers.

EXAMPLE 1

The inorganic fibers (I) were arranged monoaxially on a foil of pure aluminum (1070) having a thickness of 0.5 mm, and the same aluminum foil was put over the fibers. The assembly was then passed through hot rolls kept at 670° C. to form a composite. Twenty-seven such composites were stacked and left to stand in vacuum at 670° C. for 10 minutes and then hot-pressed at 600° C. An alumium composite material reinforced with the inorganic fibers composed mainly of silicon, titanium, nitrogen and oxygen was thus produced. The content of the fibers in the composite material was 30% by volume. Scanning electron microphotographs of a cross section taken of the resulting composite material shows that aluminum and the inorganic fibers were very well combined with each other. The resulting composite material had a tensile strength of 78 kg/mm$^2$ and a modulus of elasticity of 8900 kg/mm$^2$.

COMPARATIVE EXAMPLE 1

A silicon carbide fiber-reinforced composite material was produced in the same way as in Example 1 except that silicon carbide fibers obtained from polycarbosilane alone were used instead of the inorganic fibers (I). The resulting composite material had a fiber content of 30% by volume, a tensile strength of 37 kg/mm$^2$ and a modulus of elasticity of 6300 kg/mm$^2$, thus showing much lower strength than the composite material of this invention obtained in Example 1. This is because the strength of the silicon carbide fibers decreased to 30% of their original strength upon immersion in molten aluminum at 670° C. for 10 minutes, as shown in FIG. 1.

EXAMPLE 2

The inorganic fibers (II) were woven into a plain-weave fabric (6 wraps×6 wefts per cm; one yarn consisted of 500 fibers). Titanium metal was coated to a thickness of 0.1 to 10 microns on the resulting fabric by a plasma spraying device. A plurality of coated plain-weave fabrics were then stacked, and the interstices of the stacked fabric were filled with a powder of the titanium metal, and the assembly was compression-molded in a hydrogen gas atmosphere, pre-calcined at 520° C. for 3 hours, and hot pressed for 3 hours in an argon atmosphere at 1150° C. while applying a pressure of 200 kg/cm$^2$ to obtain a titanium composite material reinforced with the inorganic fibers composed mainly of silicon, zirconium, nitrogen and oxygen.

The resulting composite material contained 45% by volume of the inorganic fibers and a tensile strength of 148 kg/mm$^2$ which was about 2.5 times as high as the tensile strength of titanium.

COMPARATIVE EXAMPLE 2

A silicon carbide fiber-reinforced material was produced in the same way as in Example 2 except that silicon carbide fibers obtained from polycarbosilane alone were used instead of the inorganic fibers (II). The strength of the composite material was 110 kg/mm$^2$, which was inferior to that of the composite material of this invention obtained in Example 2.

EXAMPLE 3

Inorganic fibers (I), chopped to a length of 1 mm, were added to a magnesium alloy powder composed of 3% of aluminum, 1% of manganese, 1.3% of zinc and the remainder being magnesium, and they were well mixed. The mixture was filled in a stainless steel foil mold having a size of 70×50×10 mm and maintained at 490° C. and 200 kg/cm$^2$ for 1 hour in an argon atmosphere to mold it. Finally the stainless steel foil was removed and the product was abraded at the surface to give a composite magnesium alloy material. The resulting composite material contained 30% by weight of the chopped inorganic fibers (I) and had a tensile strength of 55 kg/mm$^2$.

COMPARATIVE EXAMPLE 3

A composite magnesium alloy material was produced by the same procedure as in Example 3 except that silicon carbide fibers obtained from polycarbosilane alone was used instead of the inorganic fibers (I). The resulting composite material had a tensile strength of 30 kg/mm$^2$ which was inferior to that of the composite material of this invention obtained in Example 3.

EXAMPLE 4

An inorganic fiber-reinforced composite magnesium material comprising mainly silicon, titanium, nitrogen and oxygen was produced by operating in the same way as in Example 1 except that a pure magnesium foil was used instead of the pure aluminum foil (1070). The resulting composite material contained 30% by volume of the inorganic fibers and had a tensile strength of 71 kg/mm$^2$ and a modulus of elasticity of 7500 kg/mm$^2$.

EXAMPLE 5

An inorganic fiber-reinforced composite aluminum alloy material comprising mainly silicon, titanium, nitrogen and oxygen was produced in the same way as in Example 1 except that an aluminum alloy foil (6061) was used instead of the pure aluminum foil (1070). The resulting composite material contained 30% by volume of the inorganic fibers, and had a tensile strength of 69 kg/mm$^2$ and a modulus of elasticity of 7600 kg/mm$^2$.

EXAMPLE 6

Titanium alloy (Ti-6Al-4V) was coated in a thickness of 0.1 to 10 microns on an array of monoaxially aligned inorganic fibers (II) by using a flame spray device. A plurality of such arrays of inorganic fibers were laminated one on top of the other, and the spaces among the laminated layers were filled with a titanium alloy powder, and the entire assembly was consolidated under pressure. The consolidated assembly was preliminary fired at 520° C. for 3 hours in an atmosphere of a hydrogen gas, and then hot-pressed for 3 hours in an argon atmosphere at 1150° C. while applying a pressure of 200 kg/cm$^2$. As a result, an inorganic fiber-reinforced composite titanium alloy material comprising mainly silicon, zirconium, nitrogen and oxygen was produced. The resulting composite material contained 45% by volume of the inorganic fibers, and had a tensile strength of 108 kg/mm$^2$.

What we claim is:

1. An inorganic fiber-reinforced metallic composite material comprising a matrix of a metal or its alloy and inorganic fibers as a reinforcing material, characterized in that (a) the inorganic fibers are inorganic fibers containing silicon, either titanium or zirconium, nitrogen and oxygen and being composed of (i) an amorphous material consisting substantially of Si, M, N and O, or (ii) an aggregate consisting substantially of ultrafine crystalline particles with a particle diameter of not more than 500 Å of $Si_2N_2O$, Mn, $Si_3N_4$ and/or $MN_{1-x}$, and amorphous $Si_2$ and $MO_2$, provided that in the above formulae, M represents titanium or zirconium, and x is a number represented by $0<x<1$, or (iii) a mixture of the amorphous material (i) and the aggregate (ii), and (b) said metal is selected from the group consisting of aluminum, magnesium, and titanium, or alloys thereof.

2. The composite material of claim 1 wherein said inorganic fibers contain 5 to 30% by weight of Ti or Zr.

3. The composite material of claim 1 wherein the inorganic fibers are oriented monoaxially.

4. The composite material of claim 1 wherein the inorganic fibers are oriented multiaxially.

5. The composite material of claim 1 wherein the inorganic fibers is in the form of a woven fabric of the plain, satin, imitation gauze, twill or leno weave.

6. The composite material of claim 1 wherein the inorganic fibers are in the form of a helically woven fabric or a three-dimensionally woven fabric.

7. The composite material of claim 1 wherein the inorganic fibers consist of 30 to 60% by weight of Si, 0.5 to 35% by weight of Ti or Zr, 10 to 35% by weight of N and 0.1 to 30% by weight of O in terms of elemental composition.

8. The composite material of claim 1 wherein the proportion of the inorganic fibers is 10 to 70% by volume.

* * * * *